United States Patent [19]

Sato

[11] 4,056,331

[45] Nov. 1, 1977

[54] TURBINE CONTROL SYSTEM

[75] Inventor: Seiko Sato, Tokyo, Japan

[73] Assignee: Tokyo Shibaura Denki Kabushiki Kaisha, Japan

[21] Appl. No.: 652,849

[22] Filed: Jan. 27, 1976

[30] Foreign Application Priority Data

Jan. 31, 1975 Japan ..... 50-12361

[51] Int. Cl.[2] ..... F01B 25/04

[52] U.S. Cl. ..... 415/15; 290/40 R; 364/494

[58] Field of Search ..... 415/17, 15; 60/660, 60/664, 665

[56] References Cited

U.S. PATENT DOCUMENTS 3,981,608 9/1976 Sato et al. ..... 415/15

*Primary Examiner*—Eugene G. Botz

*Attorney, Agent, or Firm*—Stevens, Davis, Miller & Mosher

[57] ABSTRACT

A turbine control system for changing over a throttle governing operation of a steam turbine to a nozzle governing operation thereof and vice versa by controlling control valves on the basis of a main control flow-rate request signal comprises function generators grouped according to the two governing operations and operating to produce function outputs in response to the opening degrees of the control valves. The function outputs are biased according to the two governing operaton and applied to respective high-value gates, the output signals of which are compared with the main control flow-rate request signal to control the opening degrees of the control valves in such a manner that the flow rate of steam introduced through the control valves into the steam turbine are maintained constant during the speed governing operation changing period.

9 Claims, 11 Drawing Figures

MAIN CONTROL SECTION
7
FUNCTION GENERATOR
9A
10A
9B
10B
20A
20B
VALVE POSITION DRIVING SECTION
15A
15B
STEAM VALVE POSITION DETECTOR
8A
8B
VALVE POSITION DETECTOR
HIGH-VALVE GATE
13A
13B
11A
11B
12A
12B
14A
14B
16
17
18
19
23
24
THROTTLE GOVERNING
NOZZLE GOVERNING
DECREASE COMMAND
INCREASE COMMAND
VOLTAGE COMPARATOR
22
EXHAUST
HT
G
2
3A
3B
4
5
6
21

TURBINE CONTROL SYSTEM

BACKGROUND OF THE INVENTION

This invention relates to a turbine control system which electro-hydraulically controls a turbine with a plurality of control valves, and more particularly to improved apparatus for controlling the opening degrees of the control valves of the turbine.

In general, in the control system of a steam turbine in which steam at high pressure and high temperature is introduced from a steam producing device to the steam turbine through a plurality of control valves, the flow-rate of the steam is controlled by operating these control valves to control the speed and output of the steam turbine.

Especially, in starting the turbine, all of the steam control valves are subjected to a so-called "throttle governing control" in which the closed steam control valves are gradually opened until the output of the turbine reaches a predetermined value, and thereafter to a so-called "nozzle governing control" in which the steam control valves are successively fully opened according to the desired output of the steam turbine. For this purpose, that is, in order to switch over the throttle governing operation to the nozzle governing operation, conventional steam turbines are provided with a control system for changing the opening degrees of the steam control valves.

In such a control system, in order that the steam control valves can maintain the desired operating performance of the turbine during operation, the "opening degree" — "steam flow-rate" characteristic of each steam control valve is corrected with the aid of a main control flow-rate request signal delivered from a speed control section or a load control section in a manner such that the opening-degree of each steam control valve is changed to a suitable value through a valve control section.

However, it should be noted that even if one and the same main control flow-rate request signal is applied to the turbine, the opening degree characteristic of each steam control valve in the throttle governing operation is different from that in the nozzle governing operation. Accordingly, when the operating condition of the turbine is quickly changed from the throttle governing control condition to the nozzle governing control condition, some of the steam control valves abruptly increase their opening degrees, and therefore steam at high temperature and high pressure rapidly flows into the turbine therethrough, thereby imparting thermal shocks to the nozzle box, the turbine casing, etc., which may cause serious damage to the turbine.

In order to overcome such difficulty accompanying the conventional steam turbines a technique has been disclosed in U.S. Pat. No. 3,688,095 (corresponding to Japanese Pat. No. 627,126). In this technique, an analog control circuit includes contact means and is therefore inevitably intricate, and during the valve-opening-degree changing operation the above-described thermal shock is liable to occur depending on the offsetting conditions of an amplifier and other elements included therein. Furthermore, in this technique the flow-rate of steam of the turbine is maintained unchanged before and after the valve-opening-degree-changing operation; however, during this valve-opening-degree changing operation the steam flow-rate is varied because no control to keep the steam flow-rate constant is provided.

Thus, it is impossible to eliminate the variation in output of the turbine by the proposed technique.

SUMMARY OF THE INVENTION

Accordingly, an object of this invention is to provide a turbine control system in which all of the above-described difficulties accompanying conventional turbine control systems have been overcome.

More specifically, an object of the invention is to provide a turbine control system by which during the speed-governing-operation changing period of a steam turbine from its throttle governing operation to its nozzle governing operation and vice versa, the opening degrees of its steam control valves are gradually changed in response to deviation from a main control flow-rate request signal thereby positively eliminating or preventing the occurrence of thermal impacts, and safely operating the steam turbine.

Another object of the invention is to provide a turbine control system by which during the speed governing operation changing period of a steam turbine, the flow-rate of steam introduced through its steam control valves into the steam turbine and accordingly the output of the steam turbine are maintained constant.

The foregoing objects and other objects of the invention have been achieved by the provision of a turbine control system for changing two speed governing operations of a steam turbine from a throttle governing operation to a nozzle governing operation and vice versa by controlling a plurality of steam control valves on the basis of a main control flow-rate request signal, which system comprises:

a. a first group of function generators for the throttle governing operation operatively coupled to the steam control valves for producing function outputs, as throttle governing feedback signals, in response to the opening degrees of the steam control valves, respectively;

b. a second group of function generators for the nozzle governing operation operatively coupled to the steam control valves for producing function outputs, as nozzle governing feedback signals, in response to the opening degrees of the steam control valves, respectively;

c. bias subtracting means connected to the function generators of the first and second groups for subtracting two bias signals from the feedback signals produced by the function generators of the first group and the feedback signals produced by the function generator of the second group to produce output signals, respectively;

d. a high-value gate circuit provided for each steam control valve for passing the higher of output signals applied thereto by the bias subtracting means;

e. first means operatively connected to the steam control valves for producing a difference signal between the main control flow-rate request signal and the sum of signals representative of actual flow-rates of the steam control valves; and f. second means connected between the first means and the bias subtracting means for increasing, according to the difference signal, one of the two bias signal which is subtracted from said feedback signals produced for one of the two speed governing operations which is not one intended to effect, and for decreasing the other bias signal which is subtracted from the feedback signals produced for the other governing operation intended to effect, whereby during a period of changing the two governing operation, an output of the turbine is kept unchanged and no thermal shock is caused to the turbine.

The nature, utility and principle of the invention will become more clearly understood from the following detailed description and the appended claims when read in conjunction with the accompanying drawings in which like parts are designated by like reference characters.

Figure 1:
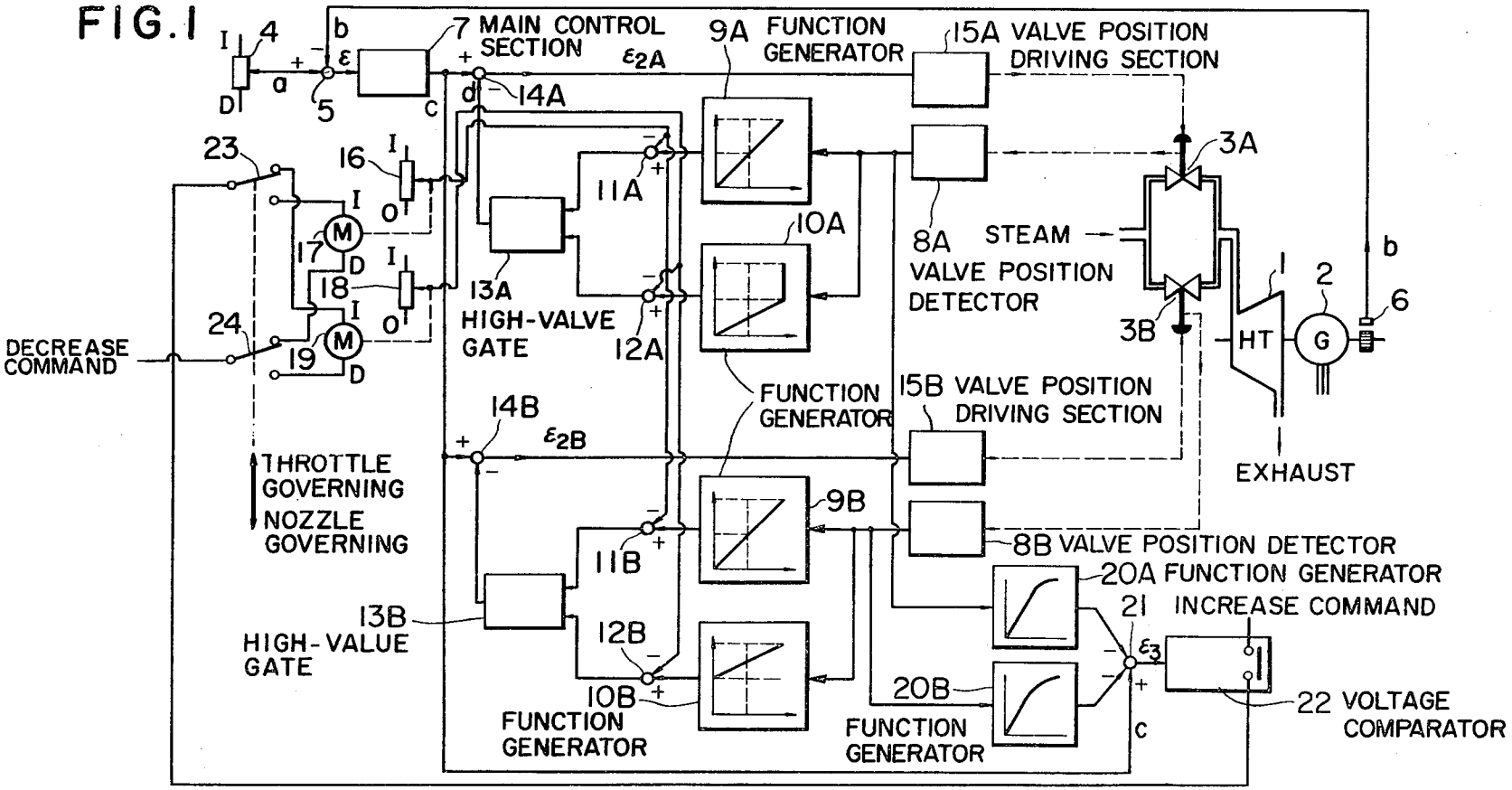
FIG. 1 is a block diagram illustrating one example of a turbine control system according to this invention.
Figure 2A:
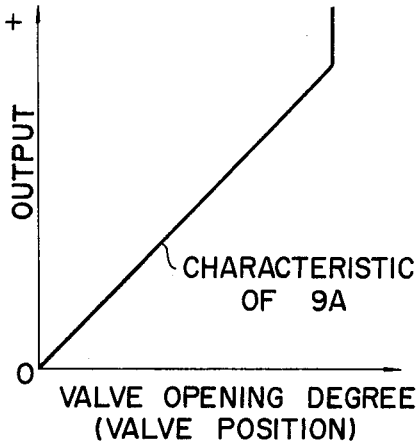
Figure 2B:
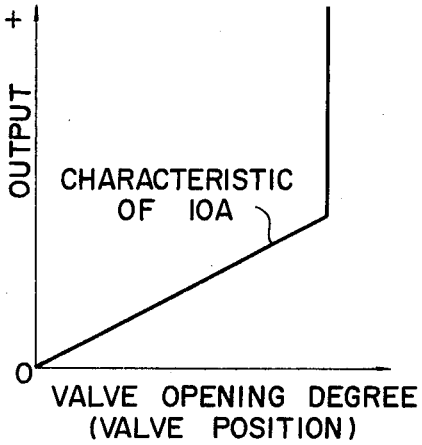
Figure 2C:
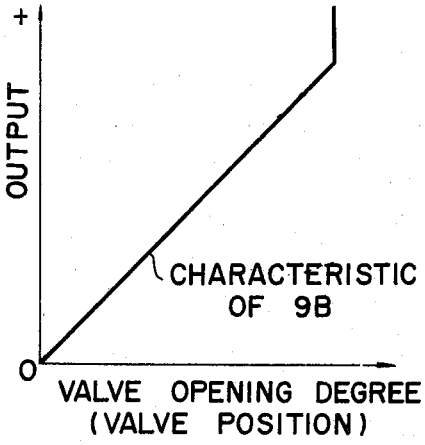
Figure 2D:
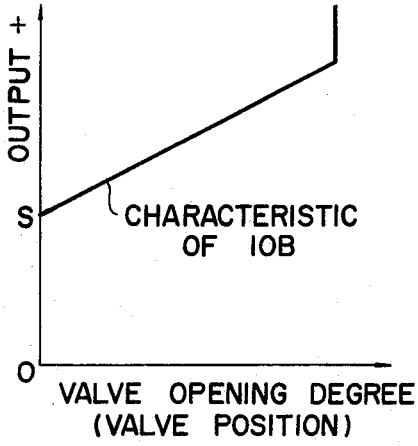

FIGS. *2a, 2b, 2c* and *2d* are graphical representations indicating the characteristics of function generators in the turbine control system shown in FIG. 1;

FIGS. *3a* and *3b* are also graphical representations indicating the outputs of adders connected to the function generators mentioned above; and FIGS. 4 to 7 are block diagrams showing parts of other examples of the turbine control system according to the invention.

DETAILED DESCRIPTION OF THE INVENTION

One preferred example of a turbine control system, according to this invention, which operates to control the speed governing operations of a steam turbine with a plurality of steam control valve is shown in FIG. 1. In this example, a steam turbine 1 is, by way of example, provided with two steam control valves 3A and 3B.

The steam turbine 1 is driven, at a speed corresponding to a speed output *a* set by a speed setting potentiometer 4, by the steam introduced through the steam control valves 3A and 3B thereinto, thus driving an electric generator 2 to which speed detector 6 is coupled for producing a speed detection signal *b*. These two outputs *a* and *b* are applied to an adder 5, which compares the former *a* with the latter *b* thereby producing a speed difference signal $\epsilon$. The speed difference signal $\epsilon$ thus produced is applied to a main control section 7, which produce a main control flow-rate request signal *c* corresponding to the signal $\epsilon$.

An adder 14A is connected to the main control section 7 for adding the signal *c* thus produced to an output signal *d* produced by a high-value gate 13A (described in detail later), and in response to the result of this addition a valve position driving section 15A connected between the adder 14A and the control valve 3A is controlled to operate the control valve 3A. The valve position or opening degree of the steam control valve 3A is detected by a first valve position detector 8A operatively connected to the control valve 3A, the detection output of which is applied to a throttle governing function generator 9A, a nozzle governing-function generator 10A, and a function generator 20A (described later). Upon application of the detection output, the function generators 9A and 10A produce function outputs or feedback signals as indicated by characteristics shown by FIGS. *2a* and *2b*, respectively.

The turbine control system further comprises adders 11A and 12A connected respectively to the function generators 9A and 10A. The adder 11A subtracts a bias signal produced by a bias producing device 16 comprising a potentiometer from the function output of the function generator 9A. The bias producing device 16 is controlled so that its bias signal is made zero during the throttle governing operation but is increased when the throttle governing operation is switched over to the nozzle governing operation. On the other hand, the adder 12A subtracts a bias signal produced by a bias producing device 18 comprising a potentiometer from the function output of the function generator 10A. The bias producing device 18 is controlled in a manner such that its bias signal becomes maximal during the throttle governing operation, and becomes minimal, or zero, during the nozzle governing operation. The results of these subtractions, or the outputs signals, of the adders 11A and 12A are applied to the high-value gate 13A described before. The high-value gate 13A operates to select the higher of the output signals of the adders 11A and 12A and feed it back to the adder 14A. The output signal thus selected is a signal representing the fact that the apparent condition of the steam control valve 3A is open.

Components 8B through 15B relate to the operation of the second steam control valve 3B and have the same functions as those of the components 8A through 15A described above in connection with the first steam control valve 3A. That is, reference characters 8B, 9B, 10B, 11B, 12B, 13B, 14B and 15B designate a valve position detector, a throttle governing function generator, a nozzle governing function generator, an adder, an adder, a high-value gate, an adder, and a valve position driving section. However, it should be noted that although the characteristic (FIG. *2c*) of the function generator 9B is equal to that (FIG. *2a*) of the function generator 9A, the characteristic (FIG. *2d*) of the function generator 10B is different from that (FIG. *2b*) of the function generator 10a, that is; the characteristic of the function generator 10B is such that the characteristic of the function generator 10A is shifted as much as a value S to increase its output, as is apparent from a comparison of the two characteristics.

The turbine control system comprises: electric motors 17 and 19 which operate the bias producing devices 16 and 18, respectively; function generators 20A and 20B connected to the valve position detectors 8A and 8B, respectively, for producing function outputs by receiving the detection signals from the valve position detectors 8A and 8B, respectively; an adder 21 connected to the function generators 20A and 20B to produce an output signal or difference signal $\epsilon_3$ representative of the difference between the main control flow-rate request signal *c* and the sum of the function outputs of the function generators 20A and 20B representative of the flow-rates of steam introduced into the steam turbine 1 through the steam control valves 3A and 3B; a voltage comparator 22 which, when the output signal $\epsilon_3$ of the adder 21 is positive ($\epsilon_3 > 0$), provides an increase command signal; and selection switches 23 and 24 each having two positions, namely, a throttle governing position and a nozzle governing position. The armatures of these switches are tripped simultaneously.

When the armatures of these switches 23 and 24 have been tripped to their throttle governing position, the increase command signal provided by the voltage comparator 22 is applied through the switch 23 to the motor 19 so that the motor 19 operates to cause the bias producing device 18 to increase its bias signal, while a decrease command signal is applied through the selection switch 24 to the motor 17. On the other hand, when the armatures of the selection switches 23 and 24 have been thrown to the nozzle governing positions, the increase command signal is applied through the selection switch 23 to the motor 17, while the decrease command signal is applied through the selection switch 24 to the motor 19.

The operation of the turbine control system according to this invention will be described in connection with the case where the steam turbine is in the throttle governing operation, and the main control flow-rate request signal *c* for a half of the rated valve opening degree is produced.

Figure 3A:
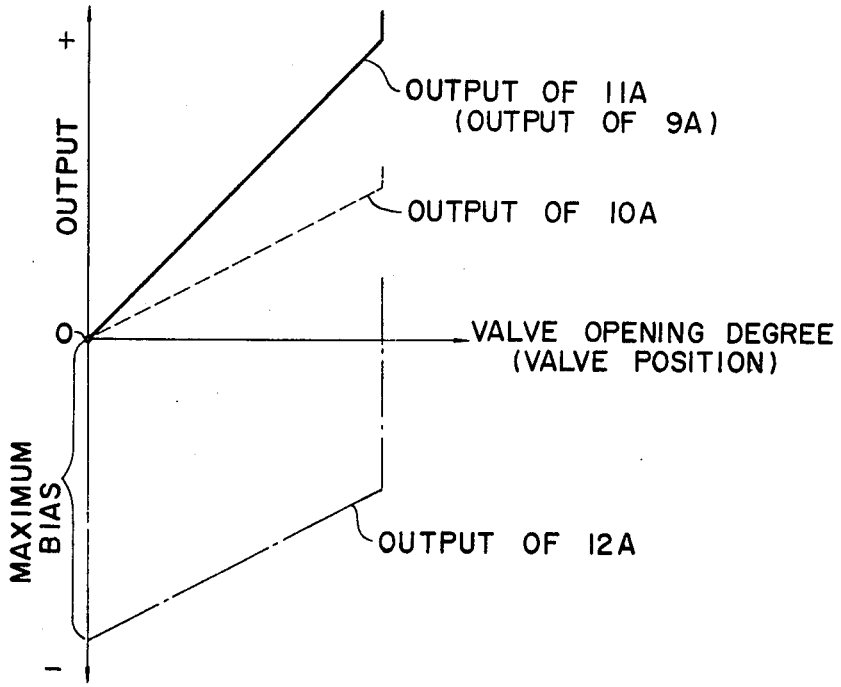
Figure 3B:
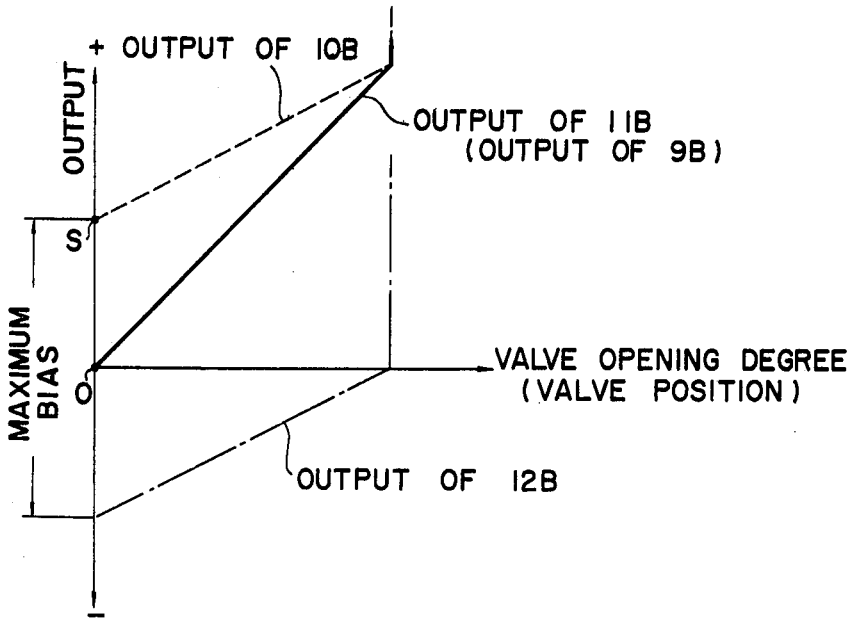

In this case, the armatures of the selection switches 23 and 24 are tripped to their throttle governing position, and therefore the bias signal of the bias producing device 16 is zero, while the bias signal of the bias producing device 18 is at the maximum. Accordingly, the outputs of the adders 11A and 12A are as indicated in FIG. 3*a,* while the outputs of the adders 11B and 12B are as indicated in FIG. 3*b;* that is, the output of the adder 11A is greater than that of the adder 12A, while the output of the adder 11B is greater than that of the adder 12B. Accordingly, the output of the high value gate 13A is the output of the function generator 9A, while the output of the high value gate 13B is the output of the function generator 9B; that is, the steam control valves 3A and 3B are controlled by the feed-back signals of the throttle governing function generators 9A and 9B, respectively.

When this throttle governing operation is changed over to the nozzle governing operation by tripping the armatures of the selection switches 23 and 24 to the nozzle governing positions, the decrease command signal is applied through the selection switch 24 to the motor 19 to decrease the bias signal of the bias producing device 18. As a result, the bias applied to the adders 12A and 12B is gradually decreased. In this connection, it should be remembered that the steam control valves 3A and 3B are not operated yet, and therefore the output of the adder 21 is maintained unchanged ($\epsilon_3 = 0$) and no increase command signal is produced by the voltage comparator 22; that is, no increase command signal is applied to the motor 17. Accordingly, the bias signal of the bias producing device 16 applied to the adders 11A and 11B remains zero. As the bias signal of the producing device 18, as described above, is gradually decreased with the rotation of the motor 19, the outputs of the adders 12A and 12B are gradually increased. Accordingly, with the decrease of the bias signal of the bias producing device 18, the output of the adder 12B first becomes equal to that of the adder 11B and then becomes greater than that of the adder 11B, as a result of which the output of the adder 12B becomes the output of the high value gate 13B. Under this condition, the second steam control valve 3B is controlled in accordance with the characteristic of the function generator 10B. However, the feedback signal delivered to the adder 14B through the high value gate 13B is increased when compared with the feedback signal which was applied to the adder 14B through the gate 13B from the adder 11B before; that is, the apparent feedback signal is increased with respect to the same or fixed valve opening degree. Since, in this example of the turbine control system, the steam control valves are controlled in a manner such that the high value gate 13B produces the same output for the same flow-rate request signal *c,* the actual opening degree of the second control valve 3B is made to decrease although the flow-rate request signal *c* is unchanged.

This decrease of the valve opening degree affects the operations of the valve position detector 8B and the function generator 20B, and causes the adder 21 to produce its difference output. As a result, the voltage comparator 22 applies the increase command signal to the bias producing device 16, so that the outputs of the adders 11A and 11B are decreased. In this case, the output of the adder 12B is greater than that of the adder 11B, and therefore the variation of the output of the bias producing device 16 does not affect the feedback signal applied to the adder 14B; however, as a result of the decrease of the output of the adder 11A the apparent opening degree of the first control valve 3A is decreased and the actual opening degree of the first control valve 3A is increased through the adder 14A and the valve position driving section 15A. The operation of the bias producing device 16 for increasing its bias signal described above is continued until the output of the adder 21 becomes zero.

If the application of the decrease command signal through the selection switch 24 is further maintained, the same operation as that described above allows the second control valve 3B to close gradually and the first control valve to open gradually. Finally, the bias signal of the bias producing device 18 becomes zero, the bias signal of the bias producing device 16 becomes maximal, the output of the adder 12A becomes greater than that of the adder 11A, and the output of the adder 12B becomes greater than that of the adder 11B. Thus, the operation of the steam turbine has switched over to the nozzle governing operation without an abrupt change of the opening degrees of the steam control valves. Furthermore, the quantity of steam introduced into the turbine is maintained unchanged before, during and after the switching operation of the two speed governing operations.

For convenience in description, the invention has been described in connection with the case where the operating mode of the turbine is changed from the throttle governing operation to the nozzle governing operation with the main control flow-rate request signal *c* corresponding to a half of the rated opening degree; however, it is understood that the invention is not limited thereby or thereto; that is, as in the above-described case, the operating mode changing operation without the thermal impact can be achieved also when the main control flow-rate request signal is smaller or greater, or the operating mode of the turbine is changed from the nozzle governing operation to the throttle governing operation.

This invention is not limited only to the example shown in FIG. 1; various changes and modifications may be made therein as described below.

Figure 4:
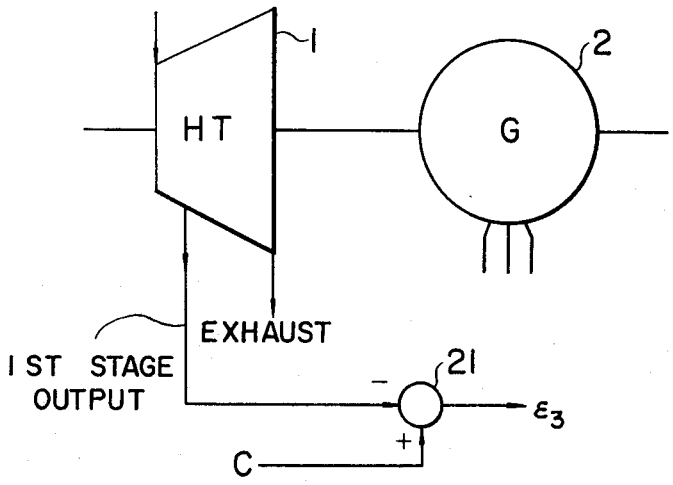

A first modification, as shown in FIG. 4, is made to a feedback signal forming section comprising the adder 21, so that a signal proportional to the mechanical output of the steam turbine 1 (that is, the first stage pressure of a high pressure turbine) is subtracted from the main control flow-rate request signal *c.*

Figure 5:
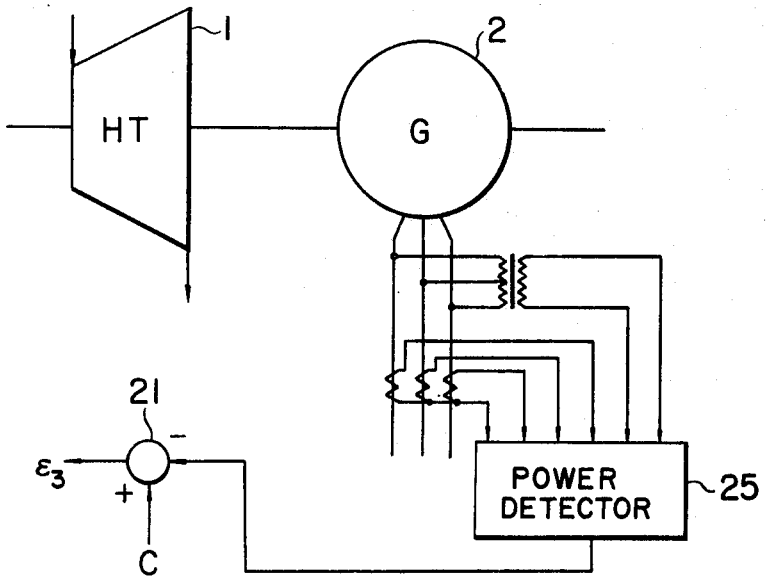

FIG. 5 shows another modification in which the electrical output of the electric generator 2 is subtracted from the main control flow-rate request signal *c.* The electrical output is detected by an electric power detector 25, the detection signal of which is applied to the adder 21.

Furthermore, it is possible to subtract a signal proportional to the middle stage pressure of a middle pressure turbine from the speed detection output signal (*b*), although such modification is not illustrated.

Figure 6:
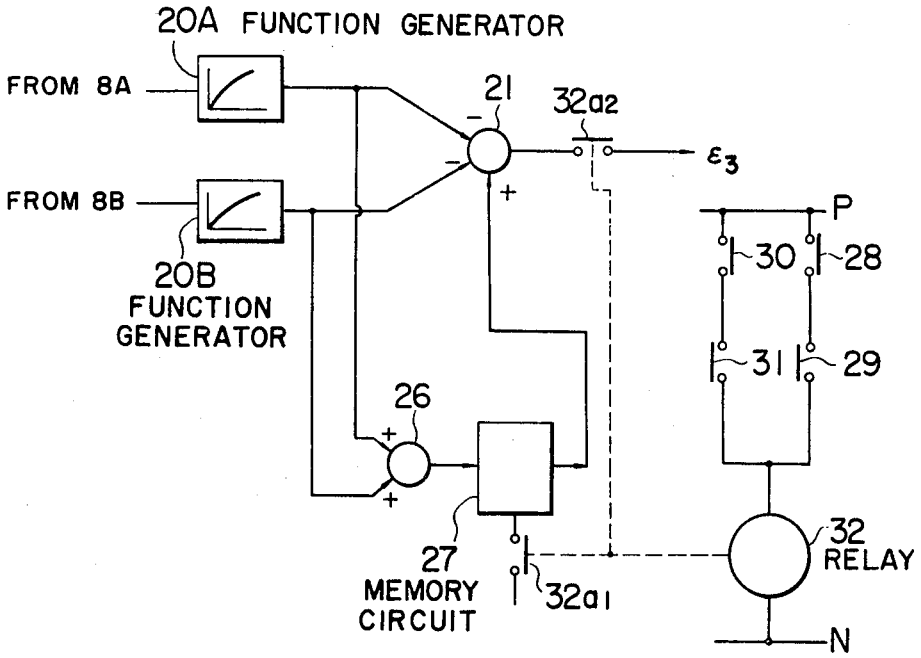

FIG. 6 illustrates another modification in which the sum of the outputs of the function generators 20A and 20B is employed, as a reference value, instead of the main control flow-rate request signal *c*. For this purpose, the modification comprises: an adder 26 connected to the function generators 20A and 20B for summing the function outputs of the function generators 20A and 20B; a memory device 27 for storing the output of the adder 26 when the contact $32_{a1}$ of a control relay 32 (described later) is closed; a contact 28 which is closed upon selection of the throttle governing operation; a contact 29 which is opened when the nozzle governing bias becomes maximal; a contact 30 which is closed upon selection of the nozzle governing operation; a contact 31 which is opened when the throttle governing bias becomes maximal; and a control relay 32 with output contacts $32_{a1}$ and $32_{a2}$.

In the modification shown in FIG. 6, the sum of the outputs of the adders 20A and 20B employed as the reference value may be replaced by the output of the electric generator 2, or the first stage pressure or the intermediate stage pressure in the high pressure casing of the turbine. The operation of the circuit shown in FIG. 6 will be described. When, as was described with reference to FIG. 1, the nozzle governing operation is switched to the throttle governing operation, for instance, the bias signal applied to the adders 11A and 11B is decreased (with the result that the outputs of these adders passes more easily through the gates), and the output of the adder 14A or 14B changes as if the value corresponding to the output which has passed through the gate earlier is operated in the valve opening direction. Therefore, the valve is operated in the valve closing direction. Simultaneously, the relay 32 is operated to close the contacts $32_{a1}$ and $32_{a2}$, whereupon the memory circuit 27 stores the output of the adder 26.

When the valve is operated in the valve closing direction, a difference arises between the flow-rate request signal and the actual flow-rate signal, and the nozzle governing bias signal is increased by the operation of the voltage comparator 22.

When the nozzle governing bias signal applied to the adders 12A and 12B becomes maximal, the switching of the nozzle governing operation to the throttle governing operation is accomplished.

Thus, in FIG. 6, in the case where the throttle governing operation is selected (the switch 28 being closed) the switch 29 is kept closed until the nozzle governing operation bias signal becomes maximal. When the bias signal becomes maximal, the switching to the throttle governing operation is completed (the switch 29 is opened by a device not shown), and the relay 32 is restored to interrupt the output to the voltage comparator 22.

Figure 7:
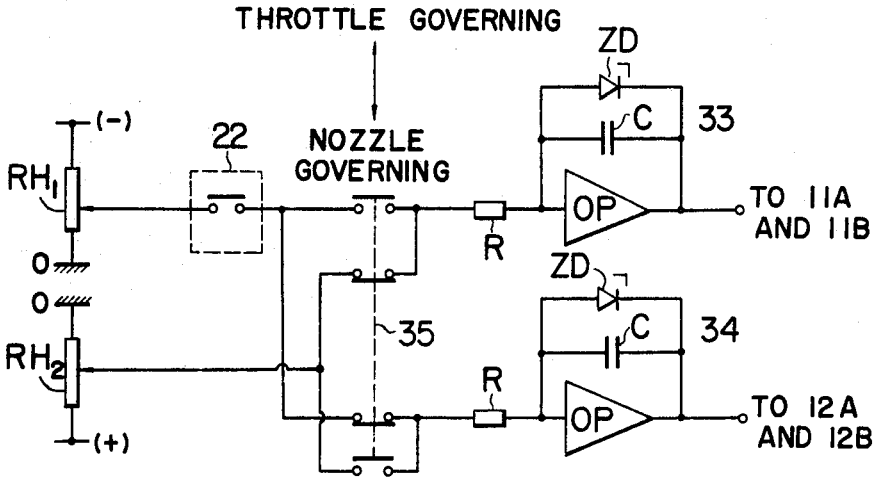

FIG. 7 illustrates another modification in which the operations of the bias producing devices 16 and 18 by the motors 17 and 19 described with reference to FIG. 1 are replaced by the operations of two electrical integrators 33 and 34 each comprising a D.C. operational amplifier OP, an input resistor R, a capacitor C, and a Zener diode ZD. The modification further comprises potentiometers $RH_1$ and $RH_2$, the above-described voltage comparator 22 and a switch 35. In this modification, the motors 17 and 19 are eliminated and therefore the bias signals to be applied to the adders 11A, 11B, 12A and 12B are accurate, and the maintenance of the turbine control system modified in this manner is very simple.

The adders 11A, 12A, 11B and 12B may be connected to the input sides of the function generators 9A, 10A, 9B and 10B, respectively.

As is apparent from the above description, the throttle governing operation of the turbine can be changed to the nozzle governing operation thereof by tripping the armatures of the switches 23 and 24. More specifically, since the operating modes of the steam turbine are switched over by the high-value gates, the opening degrees of the steam control valves can be gradually changed, and during this valve-opening-degree changing period the flow-rate of steam introduced into the steam turbine is under constant control; that is, the occurrence of the thermal impact described before can be prevented.

Furthermore, a closed loop for controlling the speed of the turbine, including the main control section, the valve position control system and the speed difference detecting section, is kept operable at all times; that is, before, during, and after the operating mode changing operation. Therefore, even if an emergency such as a load interruption is caused, it will no excessively increase the speed of the turbine and the operation of the turbine can be safely continued.

What is claimed is:

1. A turbine control system for changing two speed governing operations of a steam turbine from a throttle governing operation to a nozzle governing operation and vice versa by controlling a plurality of steam control valves on the basis of a main control flow-rate request signal, which system comprises:

a. first group of function generators for the throttle governing operation operatively coupled to said steam control valves for producing function outputs, as throttle governing feedback signals, in response to the opening degrees of said steam control valves, respectively;

b. a second group of function generators for the nozzle governing operation operatively coupled to said steam control valves for producing function outputs, as nozzles governing feedback signals, in response to the opening degrees of said steam control valves, respectively;

c. bias subtracting means connected to said function generators of the first and second groups for subtracting two bias signals from said feedback signals produced by said function generators of the first group and said feedback signals produced by said function generator of the second group to produce output signals, respectively;

d. a high-value gate circuit provided for each steam control valve for passing the higher of said output signal applied thereto by said bias subtracting means;

e. first means operatively connected to said steam control valves for producing a difference signal between said main control flow-rate request signal and the sum of signals representative of actual flow-rates of said steam control valves; and f. second means connected between said first means and said bias subtracting means for increasing, according to said difference signal, one of said two bias signal which is subtracted from said feedback signals produced for one of said two speed governing operations which is not one intended to effect, and for decreasing the other bias signal which is subtracted from the feedback signals produced for the other governing operation intended to effect, whereby during a period of changing said two governing operation, an output of said turbine is kept unchanged and no thermal shock is caused to said turbine.

2. A turbine control system as claimed in claim 1 in which said first means comprises:

a. a third group of function generators operatively connected to said steam control valves for producing function outputs by receiving said signals representative of actual flow-rates of said steam control valves, respectively;

b. a first adder connected to said function generators of the third group for adding said function outputs of said function generators of the third group and said main control flow-rate request signal, said first adder producing said difference signal when there is a difference between said main control flow-rate request signal and the sum of said function outputs produced by said function generators of the third group.

3. A turbine control system as claimed in claim 1 in which said second means comprises:

a. first and second change-over switches which are operated according to said speed governing operations, said first change-over switch receiving an increase command signal introduced with the aid of said difference signal produced by said first means, said second change-over switch receiving a predetermined decrease command signal; and b. bias producing means coupled through electric motors to said change-over switches for producing said bias signals, said electric motors being operated by said increase and decrease command signals to vary the magnitudes of said bias signals.

4. A turbine control system as claimed in claim 1 in which said first means operatively connected to a mechanical output of said steam turbine for producing a difference signal by subtracting a signal proportional to said mechanical output of said steam turbine from said main control flow-rate request signal.

5. A turbine control system as claimed in claim 4 in which said mechanical output is the first stage pressure of said steam turbine.

6. A turbine control system as claimed in claim 1 in which said first means is operatively connected to electrical means driven by said steam turbine for producing a difference signal by subtracting a signal proportional to an output of said electrical means from said main control flow-rate request signal.

7. A turbine control system as claimed in claim 6 in which said electrical means is an electric generator driven by said steam turbine.

8. A turbine control system as claimed in claim 2 in which said first means further comprises:

a. a second adder connected to said function generators of the third group for summing the function outputs thereof;

b. a memory circuit connected to said second adder to store the sum of said function outputs obtained by said second adder; and c. means for applying said sum stored in said memory circuit to said first adder according to the speed governing operations, whereby instead of said main control flow-rate request signal said sum stored in said memory circuit is employed.

9. A turbine control system as claimed in claim 1 in which said second means comprises:

a. two potentiometer for providing output signals opposite in polarity to each other;

b. two change-over switches connected to said potentiometers, respectively, said switches being operated according to said speed governing operations; and c. two electrical integrators coupled to said change-over switches for producing said bias signals by controlling the output signals of said potentiometers.

* * * * *